US005375784A

United States Patent [19]

Worley

[11] Patent Number: 5,375,784

[45] Date of Patent: Dec. 27, 1994

[54] TUB GRINDER CONSTRUCTION

[76] Inventor: Rob Worley, 508 Dunbar Rd., Chuckey, Tenn. 37641

[21] Appl. No.: 236,267

[22] Filed: May 2, 1994

[51] Int. Cl.[5] ..... B02C 13/02; B02C 21/02

[52] U.S. Cl. ..... 241/37.5; 241/101.7; 241/186.4; 241/285.3

[58] Field of Search ..... 241/186.4, 285.3, 37.5, 241/195, 101.7

[56] References Cited

U.S. PATENT DOCUMENTS

| | | | |
|---|---|---|---|
| 2,650,745 | 9/1953 | Oberwortman | 241/101.7 |
| 3,749,324 | 7/1973 | Hyde | 241/58 |
| 4,033,515 | 7/1977 | Barcell et al. | 241/27 |
| 4,364,526 | 12/1982 | White | 241/186.4 |
| 4,497,448 | 2/1985 | Joa et al. | 241/186.4 |
| 5,215,268 | 6/1993 | Houle et al. | 241/186.4 |
| 5,297,744 | 3/1994 | Clinton | 241/81 |

*Primary Examiner*—Mark Rosenbaum
*Assistant Examiner*—John M. Husar

[57] ABSTRACT

A tub grinder apparatus having a base providing a tub floor, a generally cylindrical shaped wall providing a tub side having an open top edge and an open bottom edge and being mounted on the base with the bottom edge spaced above the tub floor the mounting allowing for rotation of the tub side relative to the tub floor about a first axis, the top edge providing a substantially cylindrical top rim lying in a substantially horizontal plane and providing a top loading entry port, a grinding device mounted on the base for rotation about a second axis, the second axis being located below the upper surface of the tub floor, the grinding device having material comminuting segments mounted to move along a closed path as the grinding device is rotated about the second axis, a first portion of the closed path extending through the opening in the tub floor and above the upper surface whereby material on the tub floor within the grinding cavity can be moved over the upper surface of the tub floor into the first portion of the closed path of the segments to be comminuted thereby, and a kinetic energy dissipator movably mounted on the apparatus and adapted to be moved selectively to a blocking or an open position with respect to the entry port, the blocking position allowing the dissipator to block the exit from the apparatus of material being thrown upwardly by the force of the comminuting operation.

11 Claims, 5 Drawing Sheets

TUB GRINDER CONSTRUCTION

FIELD OF THE INVENTION

This invention concerns grinding apparatus or machinery generally referred to as tub grinders which are employed in the grinding up or size reduction of materials or items such as wood pallets, tree branches, agricultural roughages or the like, and particularly concerns structural improvements therein which markedly enhance their safety of use.

BACKGROUND OF THE INVENTION

Grinders of the tub type are widely used for chipping, breaking or tearing of items or materials which are very difficult to otherwise comminute. The process expends a great deal of mechanical energy and often involves the violent throwing of chips or pieces of varying sizes upwardly out of the tub. For this reason, such grinders are typically trailered to isolated locations such as out in the middle of a large field such that the thrown chips or pieces cannot injure property or bystanders who may come into the danger zone of the grinder which may extend outwardly therefrom several yards. Such precautions may serve their purpose very well, however, the fact remains that workers who feed the materials into the grinder and remove the comminuted product from the area, or who attend to the machinery during its operation must remain in close proximity to the grinder and are thus exposed to considerable danger, regardless of their use of hard hats or the like.

DISCUSSION OF PRIOR ART

Typical grinders or chippers of the type herein of concern are shown in the following U.S. Pat. Nos. 4,003,502; 3,743,191; 5,207,391; 4,997,135; 4,210,289; 4,106,706; 3,966,128; 5,082,188; 3,912,175; 3,743,191; 4,134,554; and 4,210,289, the disclosures of which with respect to the designs and constructions of the tubs and their rotation power mechanisms, and of the grinding means employing chipping blades, hammers, shearing or cutting rotor devices, grinding cylinders, and the like, all of which are hereinafter referred to as comminuting segments, are hereby incorporated herein by reference and are useful with the present invention.

It is particularly noted that safety considerations for these prior devices do not appear to be directed to protecting against flying chips or pieces of semi-comminuted materials which can be thrown with great force out through the tops of the tubs.

Objects, therefore of the present invention are: to provide a tub grinder apparatus which affords a high degree of operator and property protection from flying chips or pieces of material; to provide such apparatus which is safe to use in areas wherein unprotected persons or property are present; and to provide such apparatus, with the inclusion of the safety structure of the present invention, in a structural form which is easy to use and rapid in its operation.

SUMMARY OF THE INVENTION

The above and other objects hereinafter appearing have been attained in accordance with the present invention which, in its broad structural context is defined as a tub grinder apparatus having base means providing a tub floor, a generally cylindrical shaped wall means providing a tub side having an open top edge and an open bottom edge and being mounted on said base means with said bottom edge spaced above said tub floor, said mounting allowing for rotation of said tub side relative to said tub floor about a first axis, said tub floor and said tub side providing a grinding cavity, said tub floor having an upper surface and an opening therethrough, said tub side being mounted with said first axis of rotation substantially perpendicular to said upper surface, said top edge providing substantially cylindrical top rim means lying in a substantially horizontal plane and providing a top loading entry port, grinding means mounted on said base means for rotation about a second axis, said second axis being located below said upper surface of said tub floor, said grinding means having material comminuting segments mounted to move along a closed path as said grinding means is rotated about said second axis, a first portion of said closed path extending through said opening in said tub floor and above said upper surface whereby material on said tub floor within said grinding cavity can be moved over the upper surface of said tub floor into said first portion of the closed path of said segments to be comminuted thereby, kinetic energy dissipator means movably mounted on said apparatus and adapted to be moved selectively to a blocking or an open position with respect to said entry port, said blocking position allowing said dissipator means to block the exit from said apparatus of material being thrown upwardly by the force of the comminuting operation, and preferably, stop means on said apparatus adapted to engage portions of said dissipator means at said blocking position and maintain a gap between said upper rim means and said dissipator means to allow unhindered rotation of said tub side relative to said dissipator means.

In certain preferred embodiments:

(a) the mounting of said dissipator means being provided by cooperating pivot elements on said base means and said dissipator means for allowing said dissipator means to be moved easily to either of said positions, and wherein the pivot elements provide a pivot axis oriented substantially parallel to and lying in close proximity to said plane of said upper rim means;

(b) the dissipator means comprises a top wall and a substantially cylindrical side wall providing an energy dissipation chamber, said side wall having a substantially cylindrical lower rim means defining inlet means to said chamber, said lower rim means having substantially the same diameter and configuration as that of said upper rim means such that said upper and lower rim means can be brought into juxtaposition to block the exiting from the apparatus of any material thrown outwardly through said entry;

(c) one of said rim means being provided with flexible barrier means adapted to contact the other of said rim means and further block the exiting of any material thrown outwardly through said entry;

(d) the barrier means comprises a band of tough, elastomeric material secured around the outer periphery of said side wall of said dissipator means adjacent said lower rim means thereof and extending axially beyond said lower rim means to provide flexible sealing lip means surrounding said chamber inlet means, said lower rim means, said upper rim means and said barrier means being dimensioned to allow said sealing lip means to contact interior surface portions of said upper rim means when said dissipator means is moved into its blocking position;

(e) the upper rim means is slanted upwardly and outwardly and renders the interior surface portions readily accessible to said flexible sealing lip means; and (f) said dissipator means is dimensioned to provide a kinetic energy dissipation chamber having a volumetric capacity preferably of about one fourth or more of the volumetric capacity of said grinding cavity such that an adequate mass of partially comminuted, upwardly thrown material can be present at any one time within said chamber to be able to absorb sufficient energy from pieces of material thrown thereaginst to significantly diminish the destructive kinetic forces of said pieces and thereby allow the dissipator means to made sufficiently lightweight to be readily movable.

BRIEF DESCRIPTION OF THE DRAWINGS

The invention will be further understood from the following drawings of preferred embodiments and description thereof wherein:

FIG. 8 is a cross-sectional view taken along line 8—8 of FIG. 7 in the direction of the arrows;

DETAILED DESCRIPTION OF THE INVENTION

Figure 1:
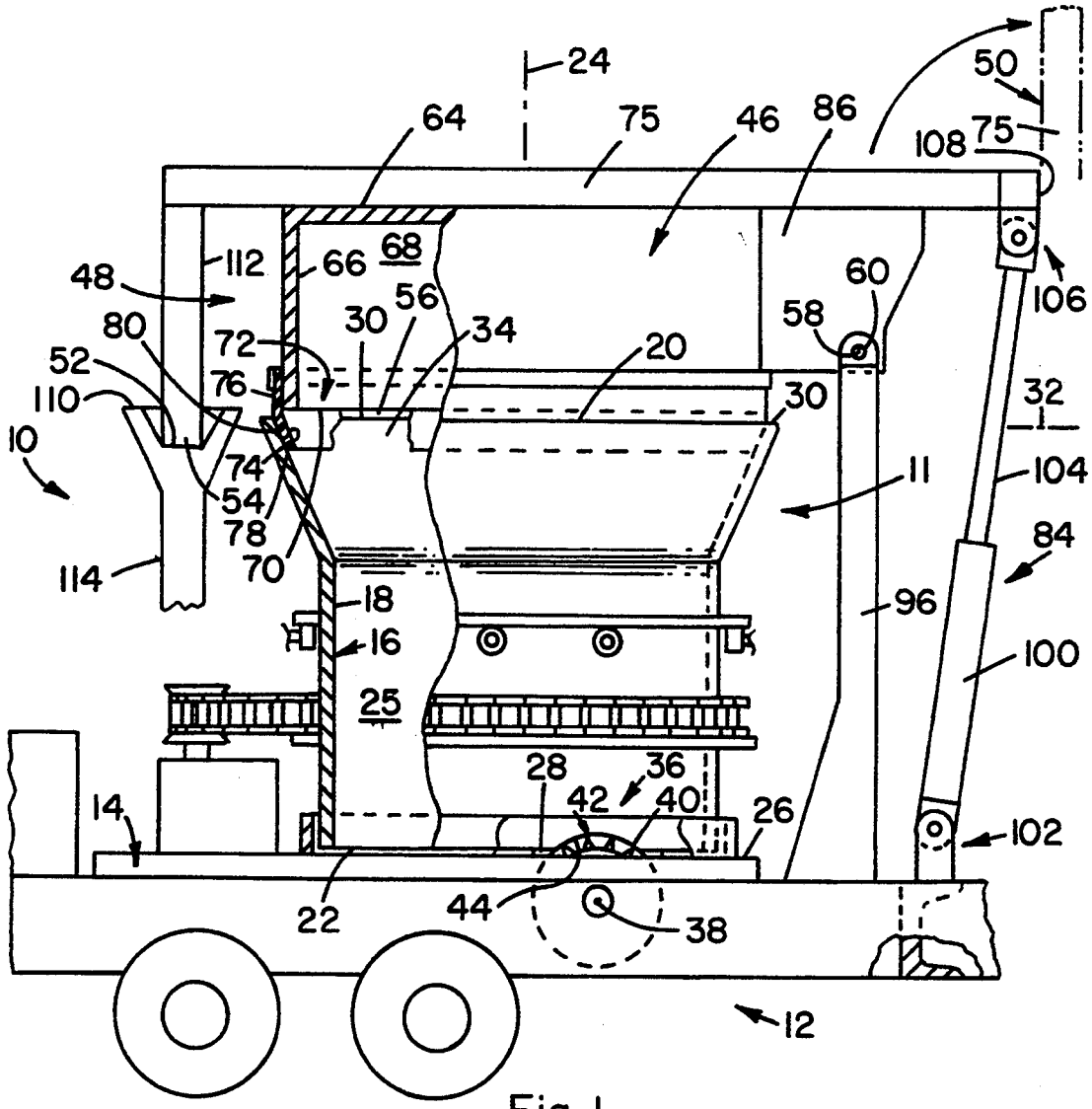
FIG. 1 is a side view, partially sectioned, of the present apparatus.
Figure 2:
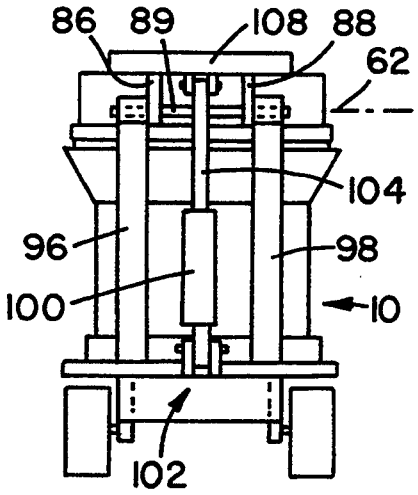
FIG. 2 is an end view of the apparatus of FIG. 1 taken in the direction of line 2 of FIG. 1.

Referring to the drawings which are not drawn to any relative scale, the tub grinder apparatus generally designated 10 having a tub 11 comprised of base means 12 providing a tub floor 14, and a generally cylindrical shaped wall means 16 providing a tub side 18 having an open top edge 20 and an open bottom edge 22 and being mounted on said base means with said bottom edge spaced above said tub floor, said mounting allowing for rotation of said tub side relative to said tub floor about a first axis 24, said tub floor and said tub side providing a grinding cavity 25, said tub floor having an upper surface 26 and an opening 28 therethrough, said tub side being mounted with said first axis of rotation substantially perpendicular to said upper surface, said top edge providing substantially cylindrical top rim means 30 lying in a substantially horizontal plane 32 and providing a top loading entry port 34, grinding means 36 mounted on said base means for rotation about a second axis 38, said second axis being located below said upper surface of said tub floor and oriented in any horizontal direction, said grinding means having material comminuting segments 40 mounted to move along a closed path 42 as said grinding means is rotated about said second axis, a first portion 44 of said closed path extending through said opening in said tub floor and above said upper surface whereby material on said tub floor within said grinding cavity can be moved over the upper surface of said tub floor into said first portion of the closed path of said segments to be comminuted thereby, kinetic energy dissipator means 46 movably mounted on said apparatus and adapted to be moved selectively to a blocking 48 or an open 50 position with respect to said entry port, said blocking position allowing said dissipator means to block the exit from said apparatus of material being thrown upwardly by the force of the comminuting operation, and preferably stop means 52 on said apparatus adapted to engage portions 54 of said dissipator means at said blocking position and maintain a gap 66 between said upper rim means and said dissipator means to allow unhindered rotation of said tub side relative to said dissipator means.

With respect to the certain preferred embodiments noted above:

(a) the mounting of said dissipator means being provided by cooperating pivot elements 58, 60 on said base means and said dissipator means for allowing said dissipator means to be moved easily to either of said positions, and wherein the pivot elements provide a pivot axis 62 oriented substantially parallel to and lying in proximity to said plane of said upper rim means;

(b) the dissipator means comprises a top wall 64 and a substantially cylindrical side wall 66 providing an energy dissipation chamber 68, said side wall having a substantially cylindrical lower rim means 70 defining inlet means 72 to said chamber, said lower rim means having substantially the same diameter and configuration as that of said upper rim means such that said upper and lower rim means can be brought into juxtaposition to block the exiting from the apparatus of any material thrown outwardly through said entry;

(c) one of said rim means being provided with flexible barrier means 74 adapted to contact the other of said rim means and further block the exiting of any material thrown outwardly through said entry;

(d) the barrier means comprises a band of tough, elastomeric material secured around the outer periphery 76 of said side wall of said dissipator means adjacent said lower rim means thereof and extending axially beyond said lower rim means to provide flexible sealing lip means 78 surrounding said chamber inlet means, said lower rim means, said upper rim means and said barrier means being dimensioned to allow said sealing lip means to contact interior surface portions 80 of said upper rim means when said dissipator means is moved into its blocking position;

(e) the upper rim means is slanted upwardly and outwardly and renders the interior surface portions readily accessible to said flexible sealing lip means; and (f) said dissipator means is dimensioned to provide said kinetic energy dissipation chamber with a volumetric capacity preferably of about one fourth or more of the volumetric capacity of said grinding cavity such that an adequate mass of partially comminuted, upwardly thrown material can be present at any one time within said chamber to be able to absorb sufficient energy from pieces of material thrown thereaginst to significantly diminish the destructive kinetic forces of said pieces and thereby allow the dissipator means to made sufficiently lightweight to be readily and quickly movable.

The dissipator means, in the context of the preferred embodiment shown, further comprises ridigfying members 75, 77 and cross-members 79, 81, 82 welded to the top wall 64. These members allow the dissipator means to be fabricated of lighter steel for enhancing its movability between its blocking and open positions. Members 75 and 77 when extended fore and aft on the dissipator means provide the structures 54 for engaging the stop means 52 and the structure 108 for attaching a lift means 84 to the dissipator means.

The pivoting mechanism for the dissipator preferably is provided by rigidifying buttresses 86, 88 welded to side wall 66 of the dissipator and to members 75, 77 respectively and providing a support for pivot rod 89 which is welded thereto as at 90. The other elements of the pivot are provided by pillow blocks 92, 94 or other such suitable bearing means in which rod 89 is journaled for rotation. These pillow blocks may be affixed to the tops of uprights 96, 98 respectively, or to other equivalent supports provided on the apparatus, preferably on the base thereof.

The lift means 84 preferably comprises a hydraulic cylinder 100 pivotally mounted on the base by means such as journal/pin mount 102, and its piston 104 pivotally mounted to end bar 108 by means such as journal/-pin mount 106, bar 108 being affixed to members 74, 76 by welding or the like. Cylinder 100 is preferably double acting and connected to hydraulic lines and valving in conventional manner such that it can be remotely operated by a worker.

Each stop means 52 preferably is provided with a generally funnel shaped lead-in guide 110 for more easily receiving the downward extension 112 of each member 75, 77 as the dissipator is pivoted to its blocking position as shown in FIG. 1. Each stop means is preferably provided on the upper end of a stanchion such as 114 affixed in any suitable manner to the base of the apparatus.

Figure 4:
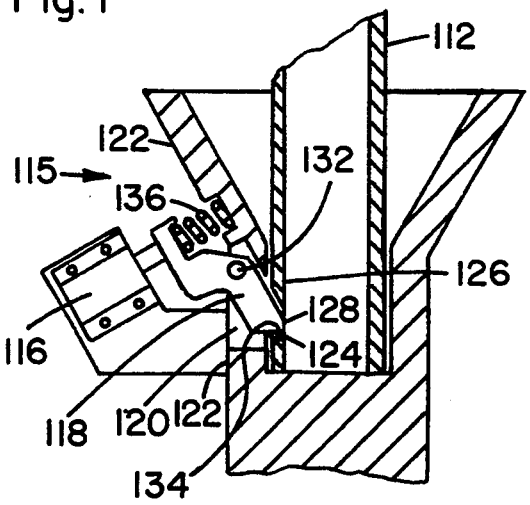
FIG. 4 is a cross-sectional view of a preferred type of stop means.
Figure 3:
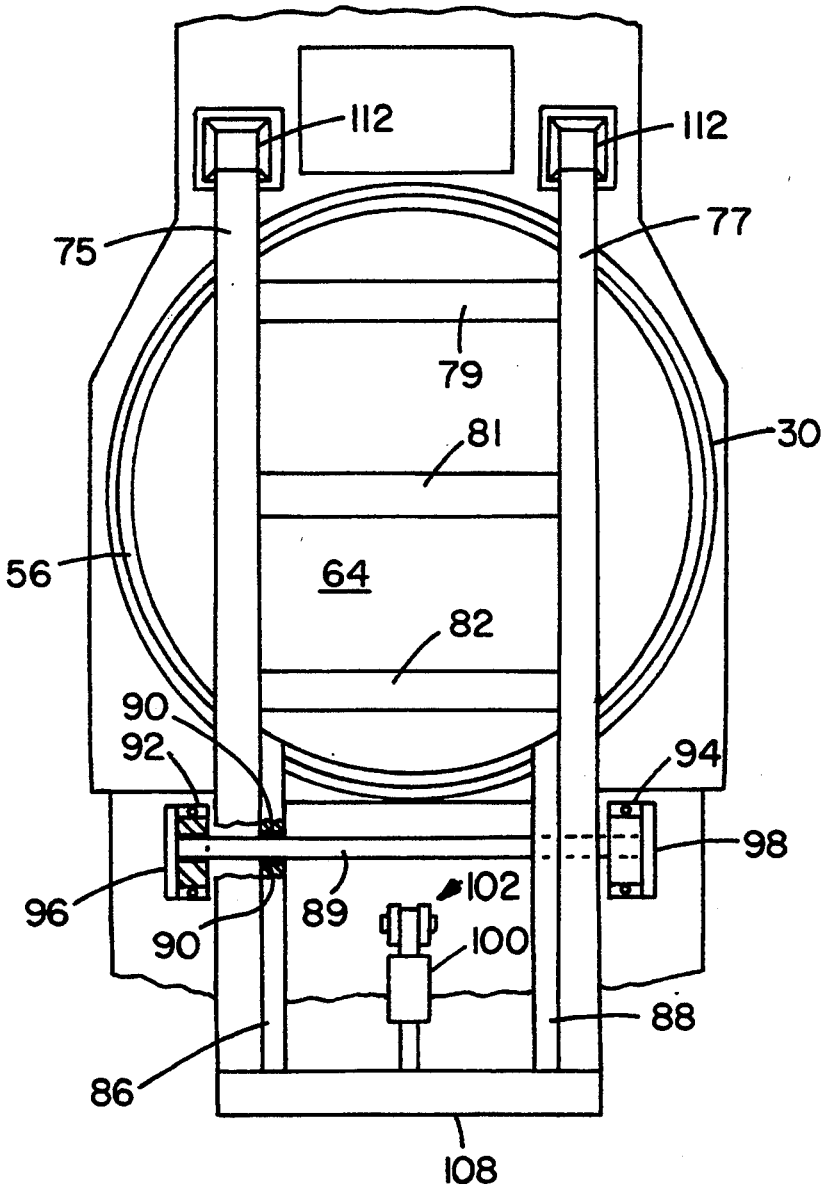
FIG. 3 is a top view of the apparatus of FIG. 1.

As shown in FIG. 4, a preferred stop means is provided with a latching device 115 such as remotely controlled solenoid 116 and stop lever 118 arrangement which automatically locks the dissipator in its blocking position but which is readily unlocked by remote actuation of the solenoid when it is desired to pivot the dissipator to its open position. This latching device comprises a slot 120 through the side wall 122 of the lead-in guide, a slot 124 in the wall 126 of the extension 112 adapted to receive the locking nib 128 of lever 118 which is pivotally mounted by pin 132 in slot 120 and which is adapted to pivot inwardly to the locking position shown in FIG. 4 and outwardly to a position whereby nib 128 is clear of shoulder 134 of the extension 112. Compression spring 136 engaging wall 122 and lever 118 continuously urges the lever counterclockwise to its locking position.

In the operation of the present apparatus, the loading operation would be initiated by unlocking the latching devices of stop means 52 where such stop means is provided, whether such would be by unlocking a manually operated lock or by actuating solenoids 116 to retract nibs 128 from shoulders 134, and then actuating lift means 84 to retract piston 104 and pivot members 75, 77 and the dissipator in a clockwise arc with reference to FIG. 1 until the dissipator and extensions 112 are sufficiently clear of loading entry 34, i.e., the open position 50, to allow feed materials such as wood pallets, brush, tree stumps, fodder or the like to be loaded therethrough into the tub grinding cavity 25 by hand or by front loaders, brush tongs or the like conventionally employed for such heavy work purposes. When the grinding cavity is loaded, the lift means is actuated to rotate the cover section counterclockwise over the tub 11 to the exact position as determined by stop means 52 wherein the correct spacing or gap 56 is provided to allow proper rotation of the tub side relative to the dissipator.

It is noted that the relative capacities of the dissipator and grinding cavity are important for achieving the desired dissipation of the kinetic energy of the upwardly thrown pieces while allowing the proper height above ground of the top of the tub. For example, if simply a flat lid were placed over the top of the tub there would be insufficient volume in which the desired physical interaction of thrown pieces to occur, and the weight and strength of the lid and its supporting structure would have to be enormous. As indicated above the ratio of the volumetric capacities of the dissipation chamber to the grinding cavity is preferably at least about $\frac{1}{4}$ and preferably from about $\frac{1}{3}$ to about 1.5/1.

Figure 5:
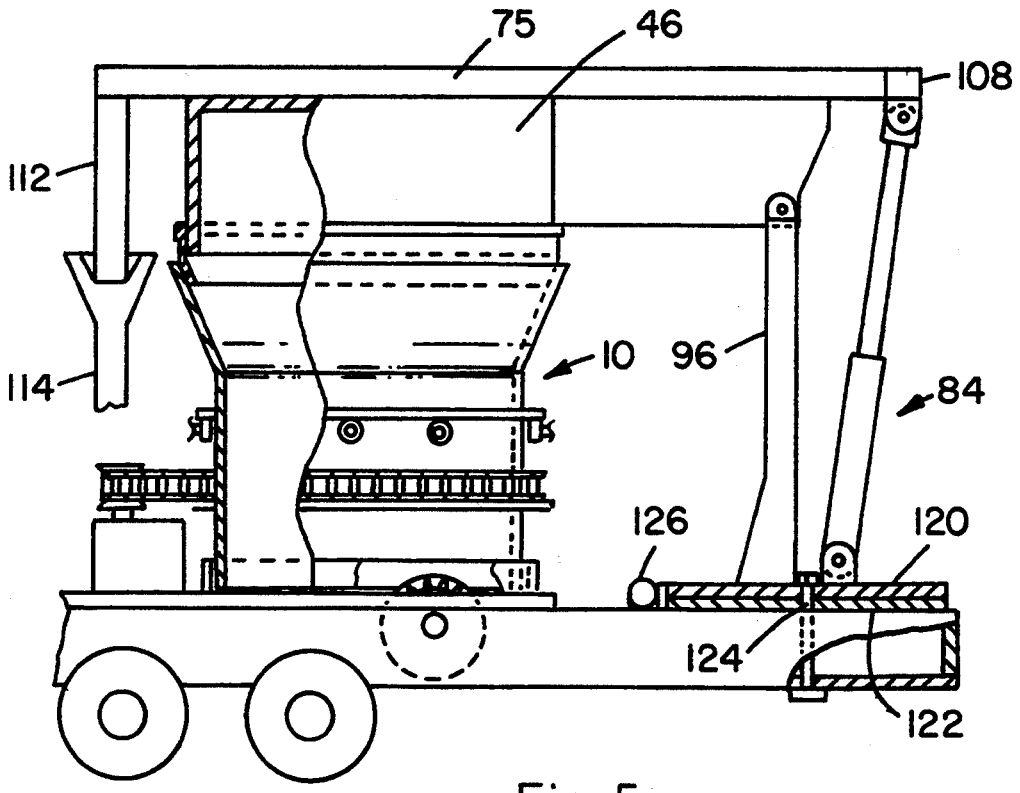
FIG. 5 is a side view, partially sectioned, of a variation of the lift mechanism of FIG. 1.
Figure 6:
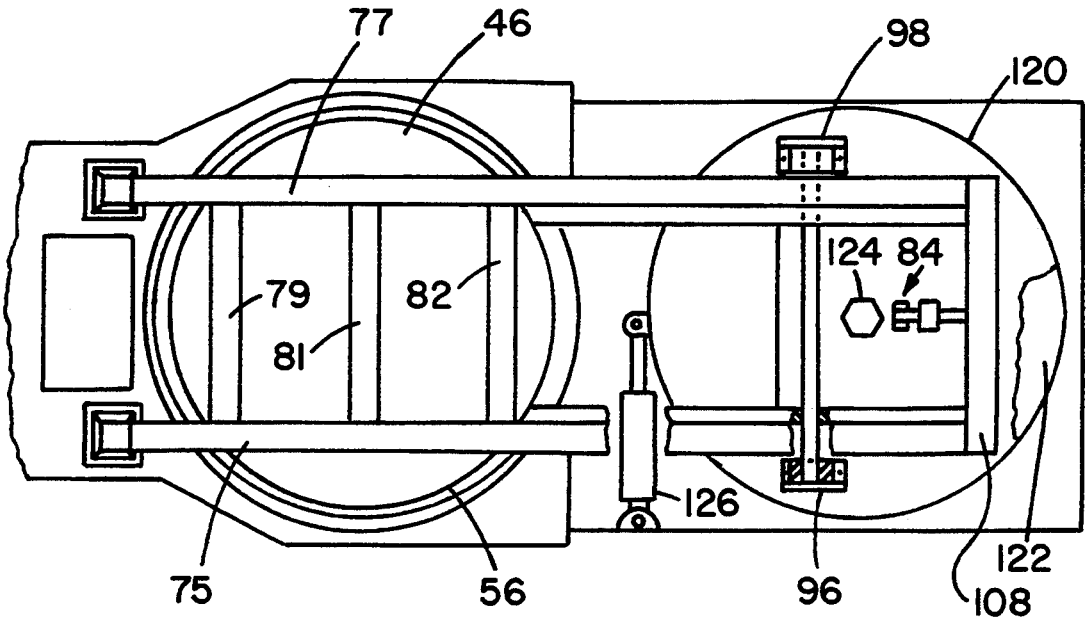

In a variation of the moving means for the dissipator as shown in FIGS. 5 and 6, uprights or support stanchions 96 and 98 and lift means 84 are mounted on a heavy turntable 120 which is rotatably mounted on the base of the apparatus, e.g., by suitable bearing means such as thrust washer 122 fixed in position on the base, and pivot pin 124. A hydraulic cylinder 126 may be provided to rotate the turntable as desired. In the operation of this moving mechanism, the dissipator need only be rotated upwardly through a relatively small arc segment, e.g., 20 or so, in order to clear the top rim 30 of the tub sufficiently to allow rotation of the turntable and dissipator out of the way of the entry port 34.

Figure 7:
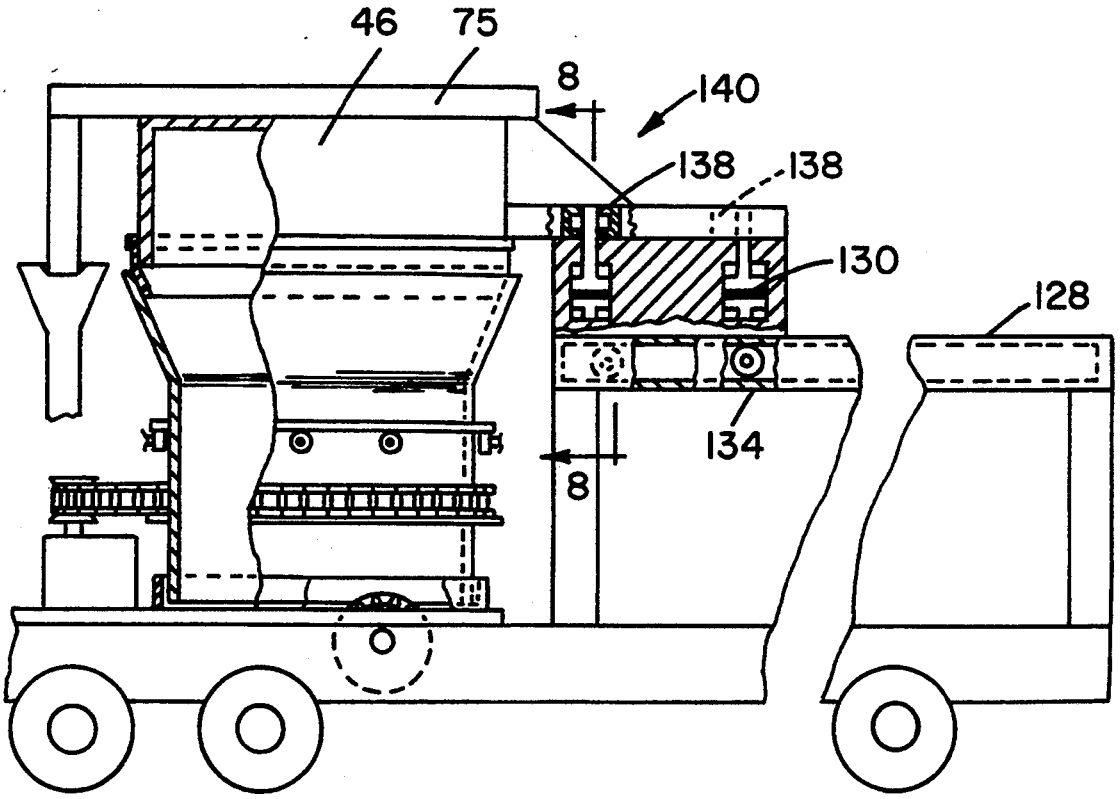
FIG. 7 is a side view, partially sectioned, of a variation of the lift mechanism.
Figure 8:
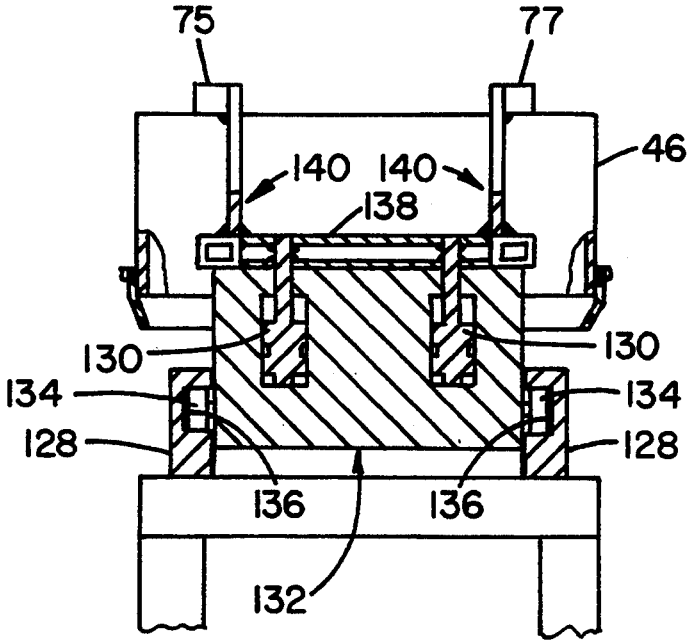
FIG. 8 is a top view of the apparatus of FIG. 5.

In another variation of the moving means as shown in FIGS. 7 and 8, the dissipator is supported on horizontal tracks 128 mounted on the base, wherein, preferably the tracks can be lifted, along with the dissipator in a vertical direction by hydraulic pistons 130 to clear rim 30, and then the dissipator moved in a generally horizontal plane along the tracks, to the right of FIG. 7 away from the entry port 34. The mounting of the dissipator on the tracks is made by trolley 132 provided with wheels 134 which roll within the races 136 of tracks 128. The upper ends of piston 130 are affixed in any suitable manner to cross-beams 138 or the like of connecting structure 140 affixed to the dissipator.

Figure 9:
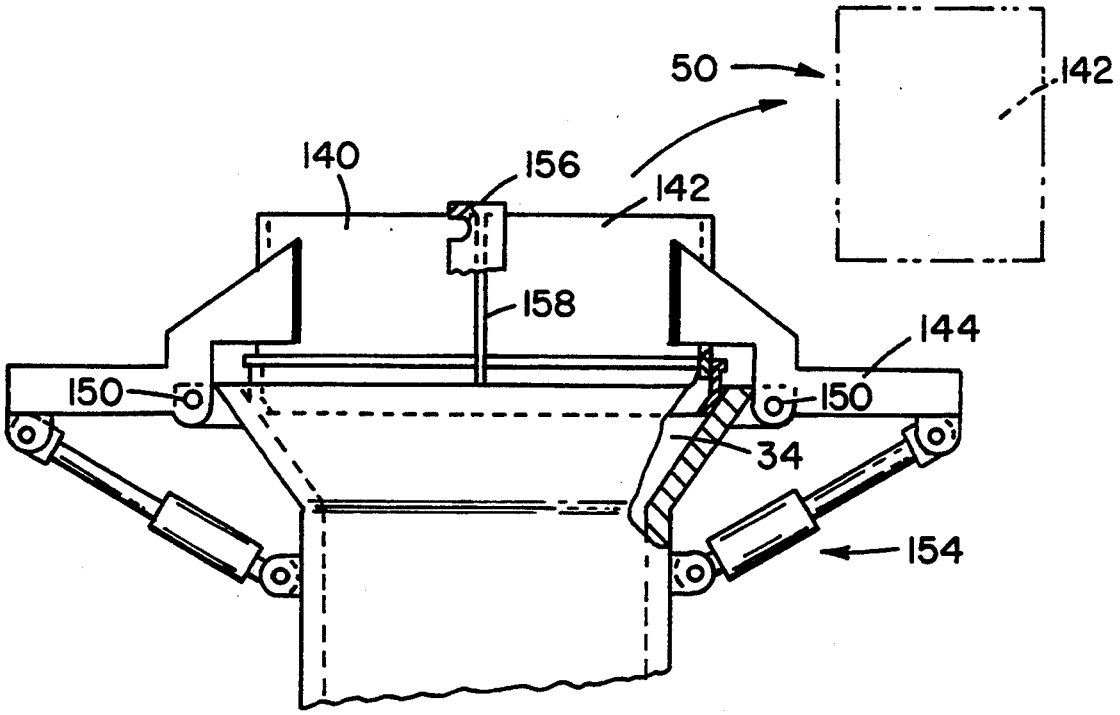
FIG. 9 is a partially sectioned side view of the apparatus of FIG. 1 showing a clam shell type variation of the lift mechanism.
Figure 10:
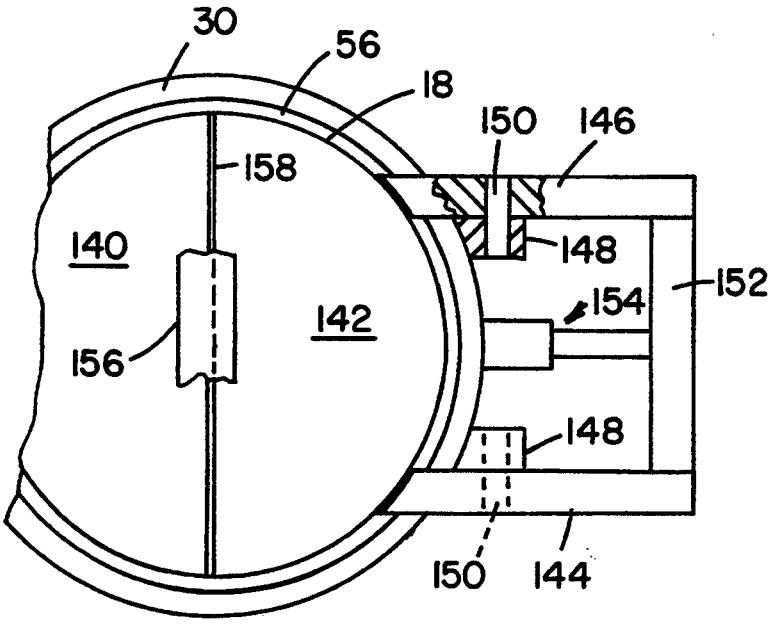
FIG. 10 is a top view of a major portion of the apparatus of FIG. 9.

In a further embodiment as shown in FIGS. 9 and 10, the dissipator is made in two halves or sections 140, 142, each of which is pivotally mounted to the base such that the two halves can be pivoted to an open position, preferably simultaneously, in the manner of a clam shell motion whereby the entry port 34 is fully open for loading. This pivoting motion is provided, e.g., by pivot arms 144, 146 welded to the side wall or other portions of the dissipator and pivotally mounted to brackets such as 148 welded to the tub side 18 by pivot pins 150. These pivot arms are connected to a cross-beam 152 to which one end a hydraulic cylinder or other lift means 154 is mounted, the other end of said lift means being connected to the tub side 18. With this construction the dissipator rotates with the tub side and the opening axes provided by pins 150 can be selected for providing convenience of loading, i.e., longitudinally or laterally of the trailer on which the tub grinder is supported. Also, with this construction, relative rotational movement between the tub side and the dissipator does not have to occur and consequently, the barrier means 74 and sealing lip means 78 are not subjected to the rather rough abrasive action generated by such relative motion. It is noted that this type of pivotal mounting may also be employed with the structure of FIG. 1. Where such mounting is desired, provision must be made for connections to the hydraulic mechanisms, e.g., quick disconnect fittings or the like, or electrically operated screw-jack type power lifters may be employed whereby sliding electrical contacts may conveniently be used.

Alternatively, however, the pivot arms 144 and lift means 154 can be mounted on the base means such that relative motion between the tub and the dissipator occurs as with the structures of FIGS. 1–8. A sealing strip 158 such as of a tough, flexible, tire-like material can be provided and adhesively or, e.g., by rivets or the like affixed to one of the halves such that upon closing of the halves said strip can effectively block any troublesome gap such as 158 between the halves 140, 142.

The invention has been described in detail with particular reference to preferred embodiments thereof, but it will be understood that variations and modifications will be effected within the spirit and scope of the invention.

I claim:

1. A tub grinder apparatus having base means providing a tub floor, a generally cylindrical shaped wall means providing a tub side having an open top edge and an open bottom edge and being mounted on said base means with said bottom edge spaced above said tub floor, said mounting allowing for rotation of said tub side relative to said tub floor about a first axis, said tub floor and said tub side providing a grinding cavity, said tub floor having an upper surface and an opening therethrough, said tub side being mounted with said first axis of rotation substantially perpendicular to said upper surface, said top edge providing a substantially cylindrical top rim means lying in a substantially horizontal plane and providing a top loading entry port, grinding means mounted on said base means for rotation about a second axis, said second axis being located below said upper surface of said tub floor, said grinding means having material comminuting segments mounted to move along a closed path as said grinding means is rotated about said second axis, a first portion of said closed path extending through said opening in said tub floor and above said upper surface whereby material on said tub floor within said grinding cavity can be moved over the upper surface of said tub floor into said first portion of the closed path of said segments to be comminuted thereby, and kinetic energy dissipator means movably mounted on said apparatus and adapted to be moved selectively to a blocking or an open position with respect to said entry port, said blocking position allowing said dissipator means to block the exit from said apparatus of material being thrown upwardly by the force of the comminuting operation.

2. The apparatus of claim 1 wherein stop means is provided on said apparatus and adapted to engage portions of said dissipator means at said blocking position and maintain a gap between said upper rim means and said dissipator means to allow unhindered rotation of said tub side relative to said dissipator means.

3. The apparatus of claim 1 wherein the mounting of said dissipator means is provided by cooperating pivot elements on said base means and on said dissipator means for allowing said dissipator means to be moved easily to either of said positions, and wherein the pivot elements provide a pivot axis oriented substantially parallel to and lying in close proximity to said plane of said upper rim means.

4. The apparatus of claim 1 wherein the dissipator means comprises a top wall and a substantially cylindrical side wall providing an energy dissipation chamber, said side wall having a substantially cylindrical lower rim means defining inlet means to said chamber, said lower rim means having substantially the same diameter and configuration as that of said upper rim means such that said upper and lower rim means can be brought into juxtaposition to at least substantially block the exiting from the apparatus of any material thrown outwardly through said entry.

5. The apparatus of claim 4 wherein one of said rim means is provided with flexible barrier means adapted to contact the other of said rim means and further block the exiting of any material thrown outwardly through said entry.

6. The apparatus of claim 5 wherein the barrier means comprises a band of tough, elastomeric material secured around the outer periphery of said side wall of said dissipator means adjacent said lower rim means thereof and extending axially beyond said lower rim means to provide flexible sealing lip means surrounding said chamber inlet means, said lower rim means, said upper rim means and said barrier means being dimensioned to allow said sealing lip means to contact interior surface portions of said upper rim means when said dissipator means is moved into its blocking position.

7. The apparatus of claim 6 wherein the upper rim means is slanted upwardly and outwardly and renders the interior surface portions readily accessible to said flexible sealing lip means.

8. The apparatus of claim 1 wherein said dissipator means is dimensioned to provide a kinetic energy dissipation chamber having a volumetric capacity of at least about one fourth of the volumetric capacity of said grinding cavity such that an adequate mass of partially comminuted, upwardly thrown material can be present at any one time within said chamber to be able to absorb sufficient energy from pieces of material thrown thereaginst to significantly diminish the destructive kinetic forces of said pieces and thereby allow the dissipator means to be made sufficiently lightweight to be readily movable.

9. The apparatus of claim 1 wherein said dissipator means has an inverted, generally bowl shaped configuration when in its blocking position and is comprised of two approximately equally sized and shaped sections, each of which is mounted on said apparatus for selected pivotal motion between said blocking and open positions.

10. The apparatus of claim 9 wherein said sections are pivotally mounted on said base means.

11. The apparatus of claim 9 wherein said sections are pivotally mounted on said tub side for rotation therewith.

* * * * *